US011510499B2

(12) United States Patent
Wu

(10) Patent No.: US 11,510,499 B2
(45) Date of Patent: Nov. 29, 2022

(54) GAMING CHAIR

(71) Applicant: Wudi Industrial (Shanghai) Co., Ltd., Shanghai (CN)

(72) Inventor: Peng Wu, Shanghai (CN)

(73) Assignee: Wudi Industrial (Shanghai) Co., Ltd., Shanghai (CN)

( * ) Notice: Subject to any disclaimer, the term of this patent is extended or adjusted under 35 U.S.C. 154(b) by 200 days.

(21) Appl. No.: 16/871,238

(22) Filed: May 11, 2020

(65) Prior Publication Data

US 2021/0345786 A1 Nov. 11, 2021

(51) Int. Cl.

| | |
|---|---|
| ***A47C 7/72*** | (2006.01) |
| ***A47C 1/032*** | (2006.01) |
| ***A47C 3/026*** | (2006.01) |
| ***A47C 7/38*** | (2006.01) |
| ***A47C 1/024*** | (2006.01) |
| ***A47C 1/03*** | (2006.01) |
| ***A47C 7/00*** | (2006.01) |
| *A47C 7/42* | (2006.01) |
| *A47C 7/02* | (2006.01) |

(52) U.S. Cl.

CPC ..... *A47C 7/727* (2018.08); *A47C 1/024* (2013.01); *A47C 1/0303* (2018.08); *A47C 7/004* (2013.01); *A47C 7/006* (2013.01); *A47C 7/0213* (2018.08); *A47C 7/383* (2013.01); *A47C 7/42* (2013.01)

(58) Field of Classification Search

CPC ..... A47C 7/727

USPC ..... 297/188.04, 188.07, 217.3, 217.4, 284.5, 297/440.21

See application file for complete search history.

(56) References Cited

U.S. PATENT DOCUMENTS

| | | | | |
|---|---|---|---|---|
| 4,431,232 A * | 2/1984 | Hannouche | A47C 7/425 | 297/284.5 X |
| 4,471,993 A * | 9/1984 | Watson | A47C 7/425 | 297/284.5 X |
| 4,516,568 A * | 5/1985 | Baxter | A61F 5/01 | 297/284.5 X |
| 4,597,386 A * | 7/1986 | Goldstein | A61F 5/01 | 297/284.5 X |
| 4,718,724 A * | 1/1988 | Quinton | A47C 7/46 | 297/284.5 X |
| 4,819,278 A * | 4/1989 | Ramos | A47K 17/02 | 297/284.5 X |
| 5,297,848 A * | 3/1994 | Grinnell | A47C 7/425 | 297/284.5 X |
| 5,863,095 A * | 1/1999 | Rivard | A47C 7/46 | 297/284.5 X |
| 5,906,413 A * | 5/1999 | Yang | B60N 2/7005 | 297/284.5 X |
| 6,755,466 B1 * | 6/2004 | Anders | A01M 31/025 | 297/188.04 X |

(Continued)

*Primary Examiner* — Rodney B White

(74) *Attorney, Agent, or Firm* — Bayramoglu Law Offices LLC

(57) ABSTRACT

A gaming chair with audio output. The gaming chair includes a movable stand member, a seat member, a backrest member, a plurality of speakers, a Bluetooth transmitter, a power supply, and an inverted triangle wiring. The seat member is disposed over the movable stand member. Further, the backrest member is hingeably coupled to the seat member. Furthermore, the inverted triangle wiring is adapted to electrically couple the plurality of speakers, the Bluetooth transmitter and the power supply to enable an electrical connection therebetween.

19 Claims, 8 Drawing Sheets

(56) References Cited

U.S. PATENT DOCUMENTS 6,783,175 B1 * 8/2004 Henderson ..... A45F 4/06 297/284.5 X
6,899,390 B2 * 5/2005 Sanfrod ..... B64D 11/0624 297/217.4
6,964,370 B1 * 11/2005 Hagale ..... A47C 31/008 297/217.3
7,125,074 B2 * 10/2006 Real ..... A47C 15/004 297/217.3
7,378,978 B2 * 5/2008 Cassaday ..... A47C 1/022 297/217.4 X
7,959,232 B2 * 6/2011 Sawada ..... B60N 2/686 297/440.21 X
8,596,716 B1 * 12/2013 Caruso ..... B60N 2/0228 297/217.3
8,858,343 B2 * 10/2014 Filipour ..... A47C 7/727 463/47
10,244,870 B1 * 4/2019 Bobst ..... A47C 7/5062
10,653,242 B2 * 5/2020 Ortiz ..... A47C 7/72
10,986,927 B2 * 4/2021 Fiden ..... A47C 7/62
2001/0026087 A1 * 10/2001 Tomita ..... A47C 7/72 297/217.4
2002/0043842 A1 * 4/2002 Nakamori ..... B60N 2/643 297/284.5
2007/0257530 A1 * 11/2007 Florez ..... A47C 15/004 297/217.3
2008/0111408 A1 * 5/2008 Duran ..... A63F 13/98 297/217.3
2009/0091163 A1 * 4/2009 Liu ..... G01C 21/36 297/217.3
2009/0206641 A1 * 8/2009 Brown, Jr. ..... A47C 7/72 297/217.3
2009/0218860 A1 * 9/2009 Hernandez ..... A47C 15/004 297/217.3
2010/0148550 A1 * 6/2010 Kidd ..... B60N 2/818 297/217.4 X
2012/0184410 A1 * 7/2012 Foster ..... A63B 21/023 482/92
2012/0223555 A1 * 9/2012 Brown, Jr. ..... A47C 15/004 297/217.4 X
2013/0059667 A1 * 3/2013 Nadal Berlinches .... A47C 4/48 463/47
2014/0219492 A1 * 8/2014 Pelliccio ..... H04R 5/023 381/389
2016/0081483 A1 * 3/2016 Harrison ..... A47C 7/448 297/217.2

* cited by examiner

GAMING CHAIR

FIELD OF THE DISCLOSURE

The present disclosure generally relates seating apparatus, and, more particularly, to a gaming chair with musical output.

BACKGROUND OF THE DISCLOSURE

The typical chairs vary in designs. They typically have seat and backrest and are made of different types of material. Some added features to these chairs include armrest, headrest, cup holders and even audio integrated into arm of chairs or any other location in the chair.

The audio currently out there may merely allow use of headphones or a commonly used large stand-alone audio system with built in speakers. From a quality audio standpoint there is no way to direct sound close to a person's ears without use of headphones, which creates other issues such as cleanliness and discomfort.

Further, existing audio systems in the chair may include complicated wiring and circuitry designs depending upon the location where the speakers are installed in such chair. Such complicated wiring and circuitry designs adds additional expense and cumbersomeness to such chair.

Accordingly, there exists a need of quality audio output that directs sound close to a person's ears without use of headphones, with easiness and cleanness. There also exists a need of such wiring and circuitry designs that are economic and simple.

SUMMARY OF THE DISCLOSURE

In view of the foregoing disadvantages inherent in the prior art, the general purpose of the present disclosure is to provide an apparatus for a gaming chair to include all advantages of the prior art, and to overcome the drawbacks inherent in the prior art.

An object of the present disclosure is to provide a gaming chair with quality audio output that directs sound close to a person's ears without use of headphones, with easiness and cleanness. Another object of the present disclosure is to provide economic and simple wiring and circuitry designs in the chair in relation to the built-in chair.

In one aspect of the present disclosure a gaming chair is provided. The gaming chair may include a movable stand member, a seat member, a backrest member, a plurality of speakers, a Bluetooth transmitter, a power supply, and an inverted triangle wiring. The seat member may be disposed over the movable stand member. The seat member may include a pair of armrests that extends from sides of the seat member. Further, the backrest member may be hingeably coupled to the seat member to be reclined between a first position and a second position. The backrest member may include a back side, and a front side opposite to the back side. The backrest member may further include a middle portion and a pair of side portions. The middle portion may extend longitudinally from the seat member. The middle portion may include longitudinal opposite sides. Further, the pair of side portions may extend longitudinally from the respective longitudinal opposite sides of the middle portion in tapered manner towards the front side. Furthermore, the plurality of speakers may include a first speaker and a second speaker. The first speaker and the second speaker are spaced apart from each other and disposed on the respective side portions along the back side. The Bluetooth transmitter may be placed behind the backrest member along the back side of the backrest member. The power supply may be placed behind the backrest member along the back side of the backrest member. Moreover, the inverted triangle wiring may be disposed inside the backrest member along the back side of the backrest member. The inverted triangle wiring may be adapted to electrically couple the plurality of speakers, the Bluetooth transmitter and the power supply to enable an electrical connection therebetween.

In one embodiment, the movable stand member may include a longitudinal member and the plurality of tapered members. The longitudinal member may extend from below the seat member, and the plurality of tapered members, each of which may include a wheel, which extends taperedly from the longitudinal member.

In one embodiment, the movable stand member may be height adjustable.

In one embodiment, the seat member may include a middle seat portion, and a pair of side seat portions. The middle seat portion may include longitudinal opposite sides. The middle seat portion may also include a front seat portion substantially above in height than a back seat portion. Further, the pair of side seat portions may extend side by side and taperedly upside from the respective longitudinal opposite sides of the middle seat portion.

In one embodiment, the seat member may be cushioned for comfort of a user.

In one embodiment, the pair of armrests may be height adjustable.

In one embodiment, the backrest member may further include at least one cutout portion to receive a head cushion support to provide additional cushioning for enabling a user to rest a head back thereof.

In one embodiment, the backrest member may be hingeably coupled to the seat member via a hinging attachment. The hinging attachment may include a first bracket element, a second bracket element and a lever element. The first bracket element may be coupled to the seat member. Further, the second bracket element may be rotatably coupled and extends from the first bracket element and coupled to the backrest member via connects. Furthermore, the lever element may be operatively coupled to the first bracket element and the second bracket element to hingeably couple the backrest member with the seat member.

In one embodiment, the backrest member may also be cushioned for comfort of a user.

In one embodiment, the first speaker and the second speaker may be at substantially same height and along a top portion of the back side of the backrest member to be played simultaneously.

In one embodiment, the first speaker and the second speaker may be removably disposed on the respective side portions along the back side of the backrest member.

In one embodiment, the Bluetooth transmitter may be removably disposed behind the backrest member.

In one embodiment, the power supply may be removably placed behind the backrest member.

In one embodiment, the inverted triangle wiring may include a first wiring member and a second wiring member. The first wiring member may diagonally extend between the first speaker and the Bluetooth transmitter. Further, the second wiring member may diagonally extend between the second speaker and the Bluetooth transmitter. The first wiring member and the second wiring member may merge at a distance above the Bluetooth transmitter, and extends therefrom as a singular wiring member up to the Bluetooth transmitter. The inverted triangle wiring may further include a third wiring member that may diagonally extend between the Bluetooth transmitter and the power supply.

In one embodiment, the gaming chair may further include a Bluetooth USB adapter coupled to the inverted triangle wiring and disposed along the back side of the backrest member. The Bluetooth USB adapter may enable the gaming chair to be compatible and connect to a PC device or a PS4™ video game console device.

In one embodiment, the gaming chair may further include a receptacle along the back side of the backrest member.

In one embodiment, the gaming chair may further include a waist cushion support to provide additional cushioning along user's waist.

This together with the other aspects of the present disclosure, along with the various features of novelty that characterize the present disclosure, is pointed out with particularity in the claims annexed hereto and forms a part of the present disclosure. For a better understanding of the present disclosure, its operating advantages, and the specified object attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

For a thorough understanding of the present disclosure, reference is to be made to the following detailed description, including the appended claims, in connection with the above-described drawings. Although the present disclosure is described in connection with exemplary embodiments, the present disclosure is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The terms, "a" and "an" herein do not denote a limitation of quantity, but rather denote the presence of at least one of the referenced items.

The present disclosure provides a gaming chair. The gaming chair may include a movable stand member, a seat member, a backrest member, a plurality of speakers, a Bluetooth transmitter, a power supply, and an inverted triangle wiring. The seat member may be disposed over the movable stand member. The seat member may include a pair of armrests that extends from sides of the seat member. Further, the backrest member may be hingeably coupled to the seat member to be reclined between a first position and a second position. The backrest member may include a back side, and a front side opposite to the back side. The backrest member may further include a middle portion and a pair of side portions. The middle portion may extend longitudinally from the seat member. The middle portion may include longitudinal opposite sides. Further, the pair of side portions may extend longitudinally from the respective longitudinal opposite sides of the middle portion in tapered manner towards the front side. Furthermore, the plurality of speakers may include a first speaker and a second speaker. The first speaker and the second speaker are spaced apart from each other and disposed on the respective side portions along the back side. The Bluetooth transmitter may be placed behind the backrest member along the back side of the backrest member. The power supply may be placed behind the backrest member along the back side of the backrest member. Moreover, the inverted triangle wiring may be disposed inside the backrest member along the back side of the backrest member. The inverted triangle wiring may be adapted to electrically couple the plurality of speakers, the Bluetooth transmitter and the power supply to enable an electrical connection therebetween.

Figure 1A:
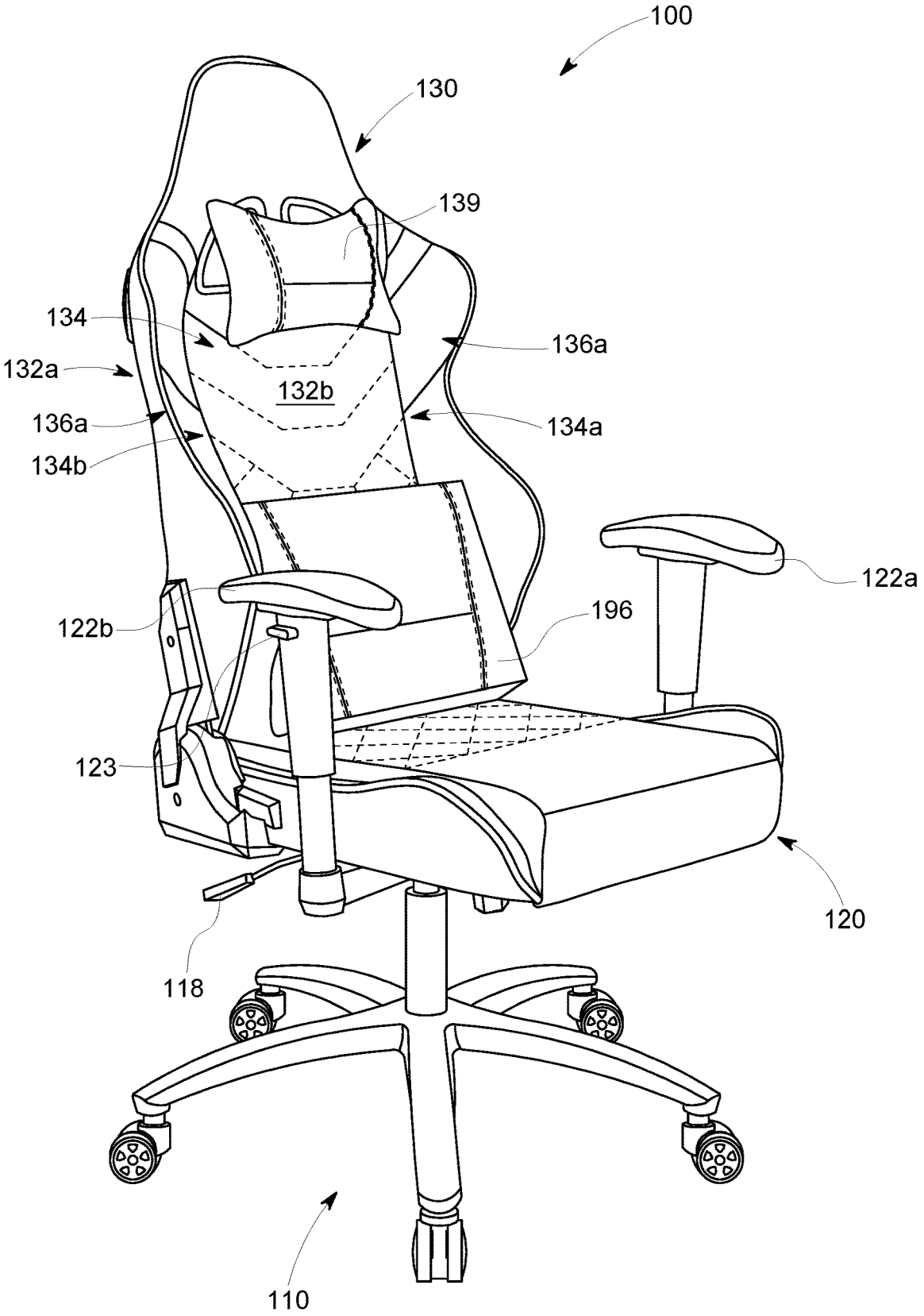
FIGS. 1A and 1B, respectively, illustrate a perspective view and a front view of a gaming chair, in accordance with an embodiment of the present disclosure.
Figure 2A:
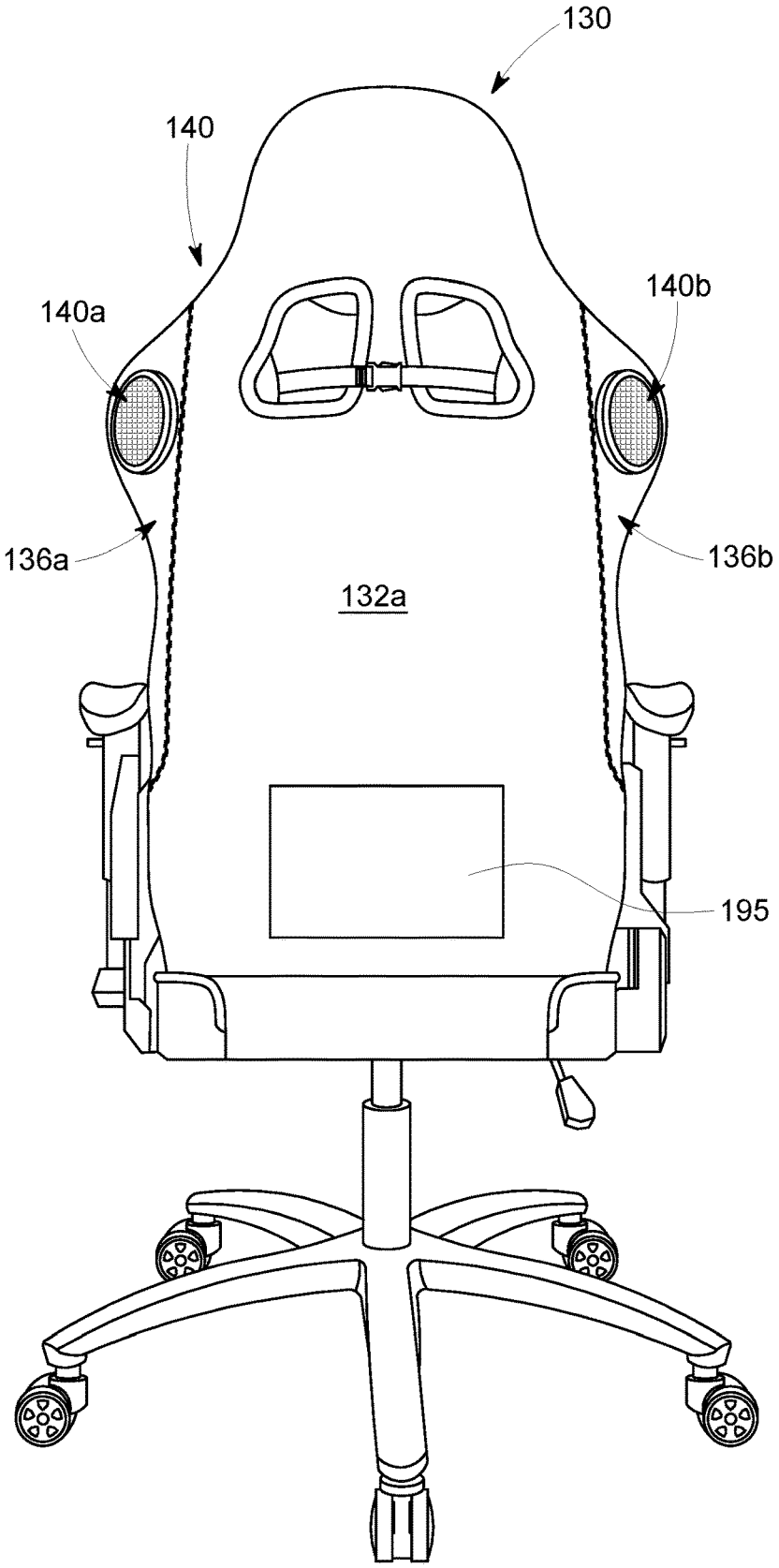
FIG. 2A illustrates a back view of a gaming chair of FIGS. 1A and 1B, in accordance with an embodiment of the present disclosure.
Figure 2B:
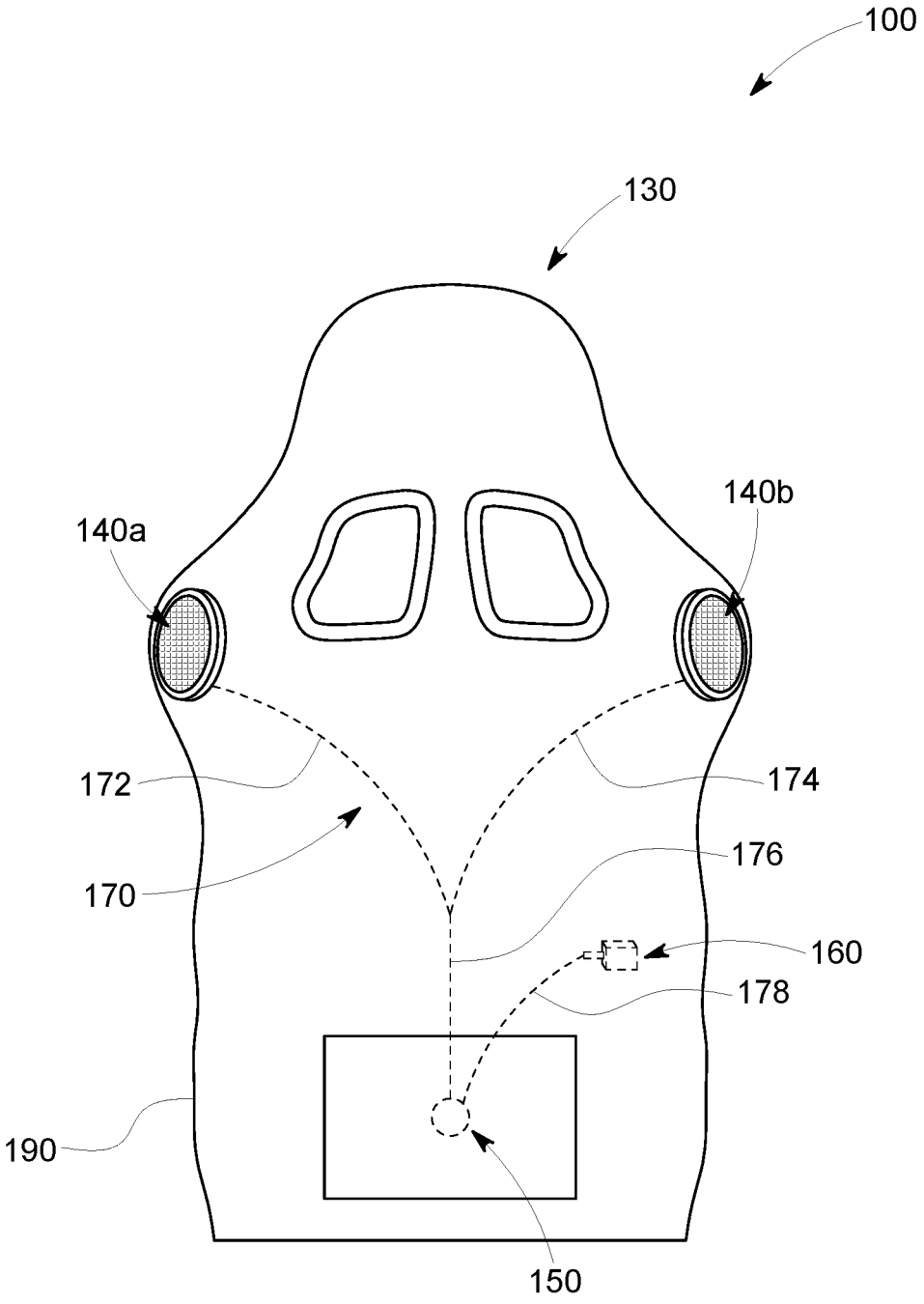
FIG. 2B illustrates a back view of a gaming chair of FIG. 2A depicting an inverted triangle wiring, in accordance with an embodiment of the present disclosure.
Figure 3A:
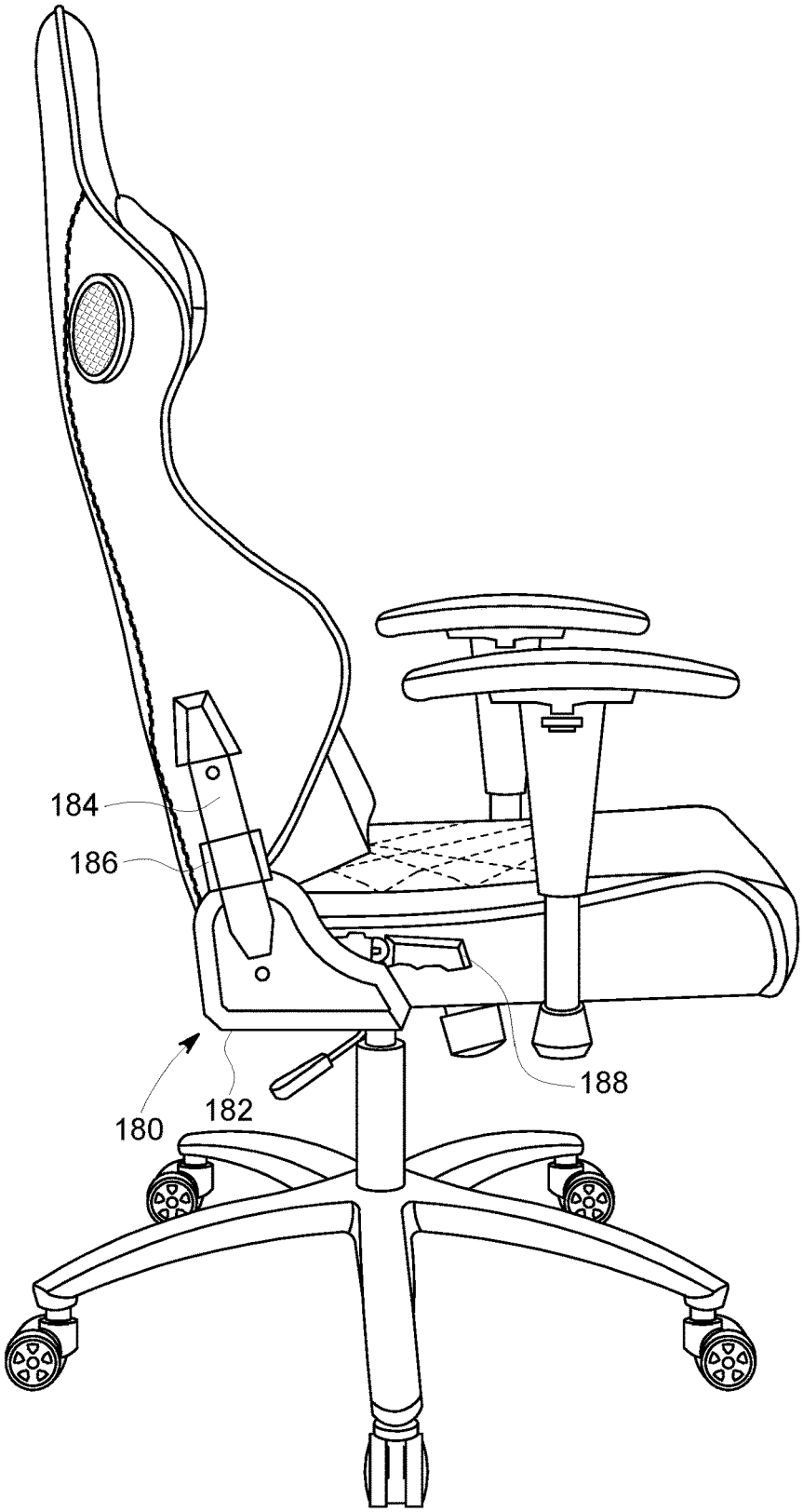
FIGS. 3A and 3B, respectively, illustrate a left-side view and a right-side view of the apparatus of FIGS. 1A and 1B, in accordance with an embodiment of the present disclosure.
Figure 3B:
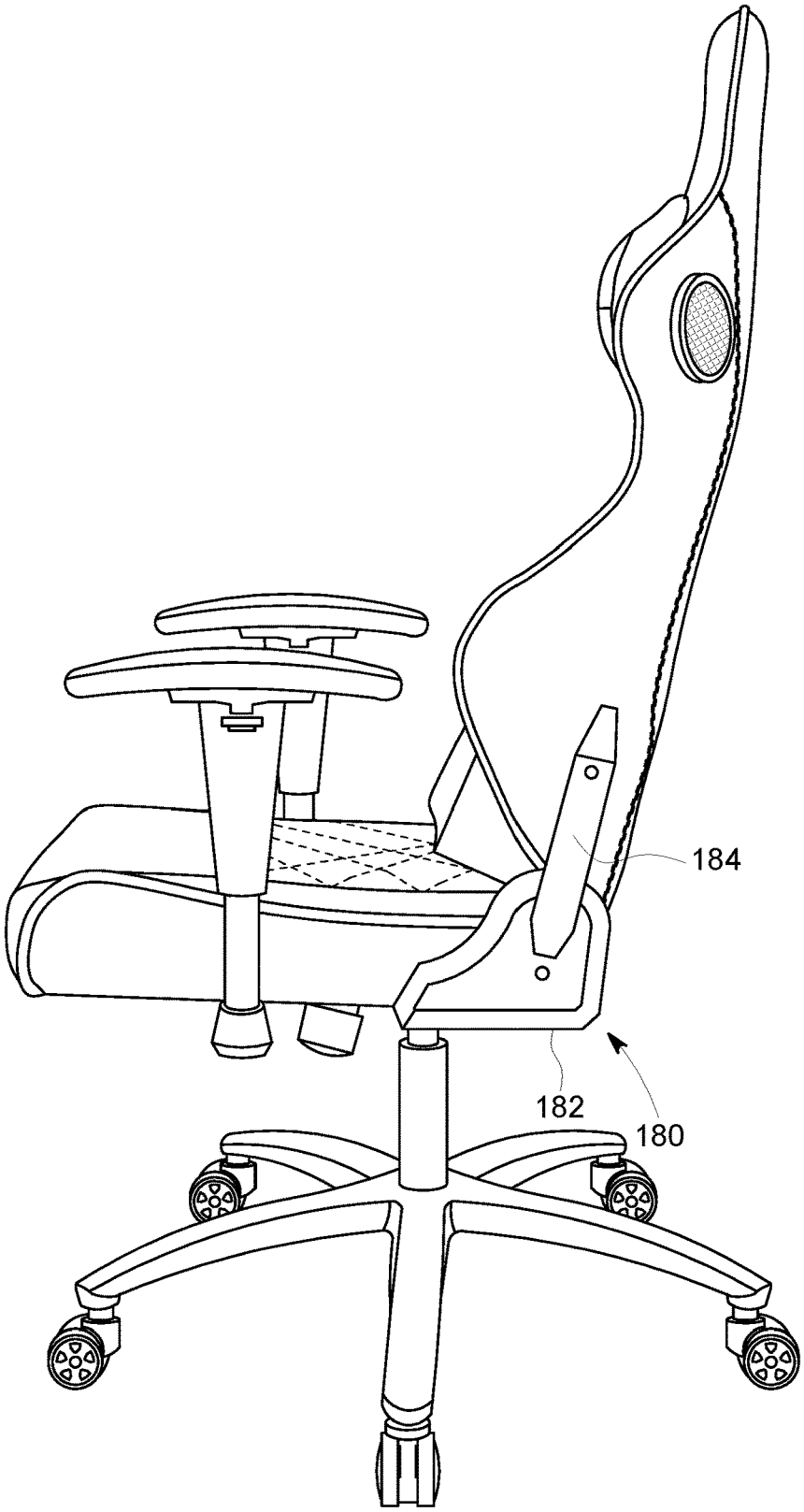
Figure 4A:
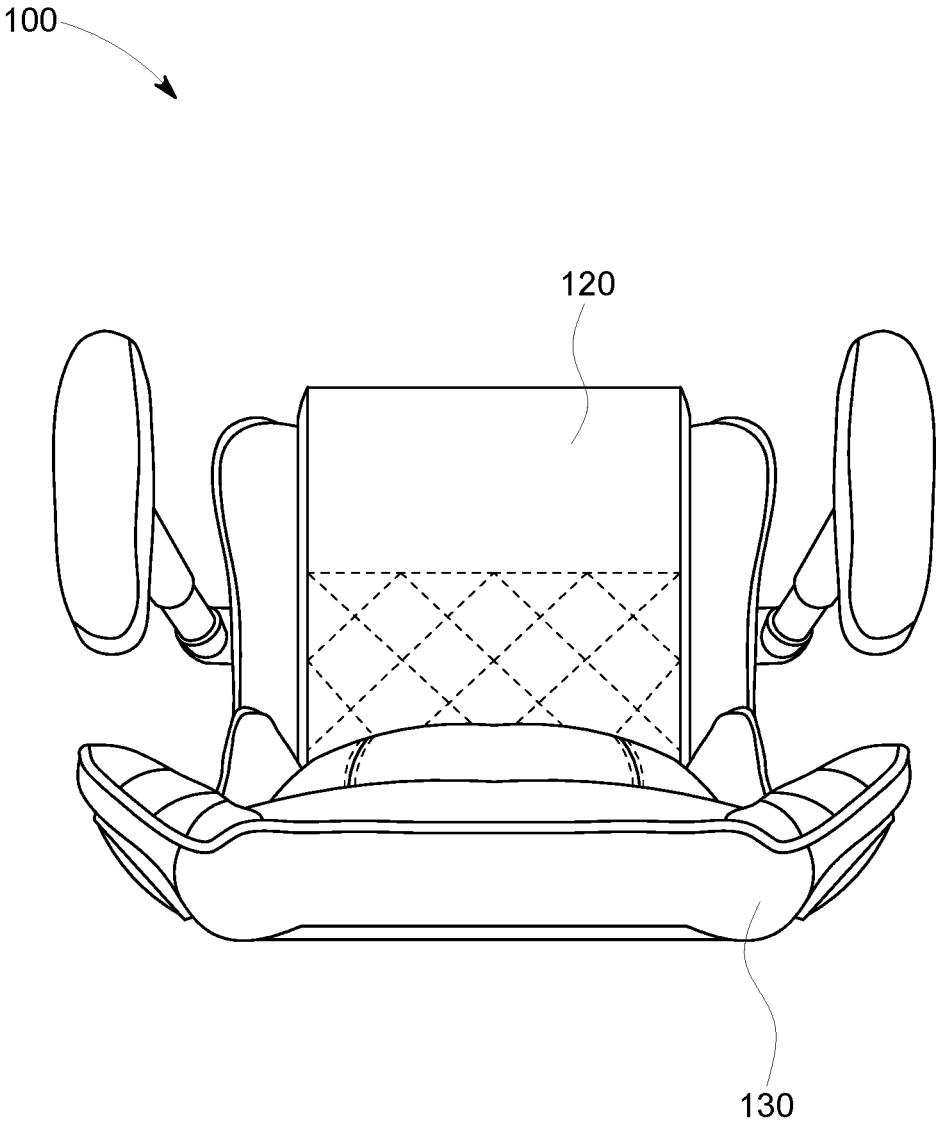
FIG. 4A illustrates a top view of a gaming chair of FIGS. 1A and 1B depicting a backrest member at a first position having an upright orientation, in accordance with an embodiment of the present disclosure.
Figure 4B:
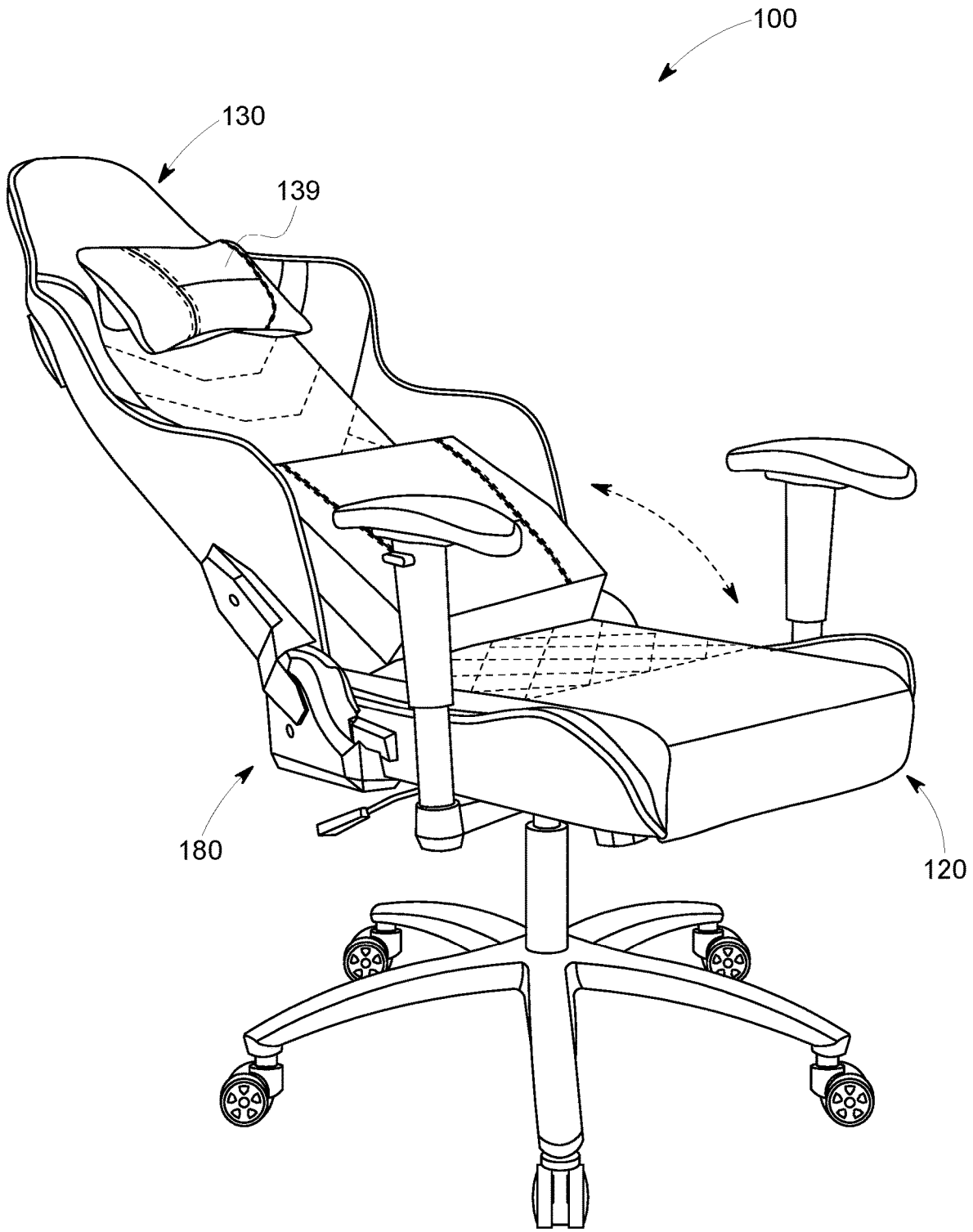
FIG. 4B illustrates a perspective view of a gaming chair of FIGS. 1A and 1B depicting a backrest member at a second position having an inclined orientation, in accordance with an embodiment of the present disclosure.

Referring now to FIGS. 1A to 4B, in one aspect of the present disclosure a gaming chair 100 is depicted. Specifically, FIGS. 1A and 1B, respectively, illustrate a perspective view and a front view of the gaming chair 100. Further, FIG. 2A illustrates a back view of the gaming chair 100 of FIGS. 1A and 1B. Further, FIG. 2B illustrates a back view of the gaming chair 100 of FIG. 2A depicting an inverted triangle wiring, in accordance with an example embodiment of the present disclosure. Furthermore, FIGS. 3A and 3B, respectively, illustrate a left-side view and a right-side view of the gaming chair 100 of FIGS. 1A and 1B, in accordance with an embodiment of the present disclosure. Moreover, FIG. 4A illustrates a top view of the gaming chair 100 of FIGS. 1A and 1B depicting a backrest member at a first position having an upright orientation, and FIG. 4B illustrates a perspective view of the gaming chair 100 of FIGS. 1A and 1B depicting a backrest member at a second position having an inclined orientation, in accordance with an embodiment of the present disclosure. As shown, in one example arrangement, the gaming chair 100 may include a movable stand member 110, a seat member 120, a backrest member 130, a plurality of speakers 140, a Bluetooth transmitter 150, a power supply 160, and an inverted triangle wiring 170. The seat member 120 may be disposed over the movable stand member 110. Further, the backrest member 130 hingeably coupled to the seat member 120. Furthermore, the inverted triangle wiring 170 is adapted to electrically couple the plurality of speakers 140, the Bluetooth transmitter 150 and the power supply 160 to enable an electrical connection therebetween, thereby making the gaming chair 100 to be musical.

Figure 1B:
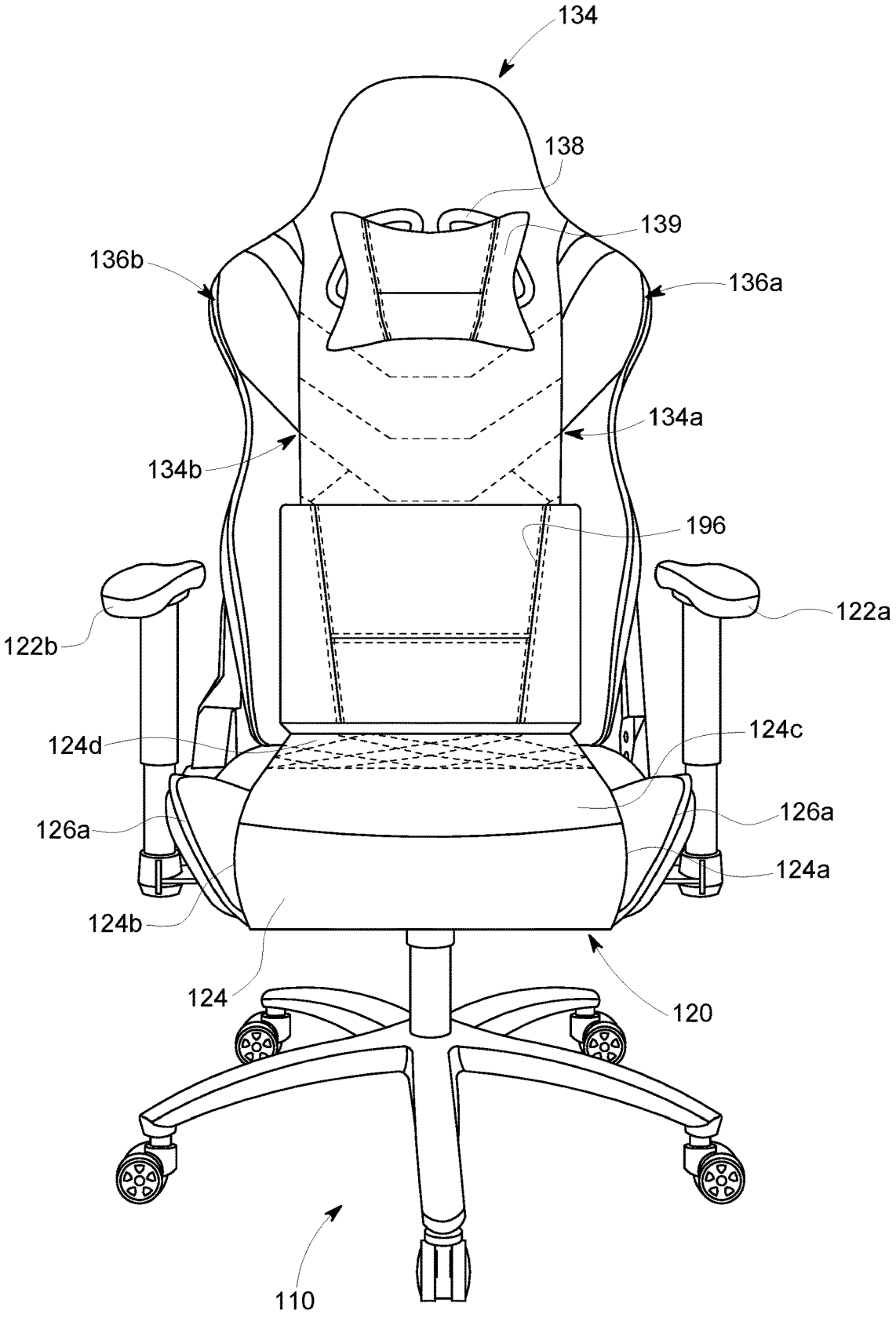

As can be seen in FIGS. 1A and 1B, in one embodiment, the seat member 120 may be disposed over the movable stand member 110. In one embodiment, the movable stand member 110 may include a longitudinal member 112 and the plurality of tapered members 114. The longitudinal member 112 may extend from below the seat member 120, and the plurality of tapered members 114, each of which may include a wheel 116, extends taperedly from the longitudinal member 112. In one embodiment, the movable stand member 110 is height adjustable and the height thereof can be adjected via a height adjusting lever 118.

Further, in one embodiment, the seat member 120 may include a middle seat portion 124, and a pair of side seat portions 126*a*, 126*b*. The middle seat portion 124 may include longitudinal opposite sides 124*a*, 124*b*. The middle seat portion 124 may include a front seat portion 124*c* substantially above in height than a back seat portion 124*d*. Further, the pair of side seat portions 126*a*, 126*b* may extend side by side and taperedly upside from the respective longitudinal opposite sides 124*a*, 124*b* of the middle seat portion 124. Such a structure of the seat member 120 may provide comfort to a user who is seating on the gaming chair 100.

In one embodiment, the seat member 120 may be cushioned for comfort of a user. In one further embodiment, the gaming chair 100 may include a waist cushion support 196 to provide additional cushioning along the user's waist.

Further, in one embodiment, the seat member 120 may include a pair of armrests 122*a*, 122*b* that extends from sides of the seat member 120. In one embodiment, the pair of armrests 122*a*, 122*b* may be height adjustable and the height thereof can be adjected via a height adjusting push buttons 123.

Further, the backrest member 130 of the gaming chair 100 may be hingeably coupled to the seat member 120 to be reclined between a first position and a second position. As can be seen in FIG. 4A, which illustrates a top view of the gaming chair 100, depicts the backrest member 130 at the first position having an upright orientation, and in FIG. 4B that illustrates a perspective view of the gaming chair 100 depicts the backrest member 130 at the second position having an inclined orientation.

In one embodiment, the backrest member 130 may be hingeably coupled to the seat member 120 via a hinging attachment 180 and can be seen in FIGS. 3A and 3B. As seen, the hinging attachment 180 may include a first bracket element 182, a second bracket element 184 and a lever element 188. The first bracket element 182 may be coupled to the seat member 120. Further, the second bracket element 184 may be rotatably coupled and extends from the first bracket element 182 and coupled to the backrest member 130 via connectors 186. Furthermore, the lever element 188 may be operatively coupled to the first bracket element 182 and the second bracket element 184 to hingeably couple the backrest member 130 with the seat member 120. The user may navigate the lever element 188 to change the position of the backrest member 130 to be reclined between the first position and the second position with respect to the seat member 120. By navigating the lever element 188, the backrest member 130 at the first position may be inclined to the upright orientation, as seen in FIG. 4A. Further, by navigating the lever element 188, the backrest member 130, at the second position may be inclined to the inclined orientation, as seen in FIG. 4B.

Referring further to FIGS. 1A and 1B, the backrest member 130 may include a back side 132*a*, and a front side 132*b* opposite to the back side 132*a*. The backrest member 130 may further include a middle portion 134 and a pair of side portions 136*a*, 136*b*. The middle portion 134 may extend longitudinally from the seat member 120. The middle portion 134 may include longitudinal opposite sides 134*a*, 134*b*. Further, the pair of side portions 136*a*, 136*b* may extend longitudinally from the respective longitudinal opposite sides 134*a*, 134*b* of the middle portion 134 in a tapered manner towards the front side 132*b*.

In one embodiment, the backrest member 130 may also be cushioned for comfort of a user for comfort of a user. Further, in one embodiment, the backrest member 130 may include at least one cutout portion 138 to receive a head cushion support 139 to provide additional cushioning for enabling a user to rest the head thereon.

Referring now to FIGS. 2A and 2B, the plurality of speakers 140 may include a first speaker 140*a* and a second speaker 140*b*. The first speaker 140*a* and the second speaker 140*b* are spaced apart from each other and disposed on the respective side portions 136*a*, 136*b* along the back side 132*a*. In one embodiment, the first speaker 140*a* and the second speaker 140*b* may be at substantially same height and along a top portion of the back side 132*a* of the backrest member 130 to be played simultaneously. In one embodiment, the first speaker 140*a* and the second speaker 140*b* may be removably disposed on the respective side portions 136*a*, 136*b* along the back side 132*a* of the backrest member 130.

In one embodiment of the present disclosure, the plurality of speakers 140 in the gaming chair 100 may be adjusted in terms of height depending upon the person sitting on the gaming chair 100. For example, if the person or the user is child (i.e. small in height) he obviously cannot reach to the exact height of the plurality of speakers 140 of the gaming chair 100 made for adult users (i.e. bigger in height). Similarly, if the person or the user is adult, he obviously may not reach to the exact height of the plurality of speakers 140 of the gaming chair 100 made for child users. Therefore, in such embodiments, the plurality of speakers 140 may be adjustable in the gaming chair 100. For such an arrangement, each of the side portions 136*a*, 136*b* of the backrest member 130 may include a respective track arrangement (not shown) on the backside thereof. In each such respective track arrangement, the first speaker 140*a* and the second speaker 140*b* are slidably coupled to be slidably move up and down to be adjusted as per the height of the person. The track arrangement may include parallelly spaced tracks, and a groove disposed between the parallelly spaced tracks, both extending vertically with respect to the backrest member 130 of the gaming chair 100. In such embodiment, the first speaker 140*a* and the second speaker 140*b* may be slid along the respective track arrangement to be positioned at a particular height depending upon the person sitting on the gaming chair 100.

Further, in one embodiment, as seen in FIGS. 2A and 2B, the Bluetooth transmitter 150 may be placed behind the backrest member 130 along the back side 132*a* of the backrest member 130. The Bluetooth transmitter 150 may be removably disposed behind the backrest member 130. The Bluetooth transmitter 150 may be adapted to connected to a mobile phone, making the thereto an external audio device for the phone.

Further, in one embodiment, as also seen in FIGS. 2A and 2B, the power supply 160 may be placed behind the backrest member 130 along the back side 132*a* of the backrest member 130. In one embodiment, the power supply 160 may be removably placed behind the backrest member 130.

Moreover, in one embodiment, as also seen in FIGS. 2A and 2B, the inverted triangle wiring 170 may be disposed inside the backrest member 130 along the back side 132*a* of the backrest member 130. The inverted triangle wiring 170 may be adapted to electrically couple the plurality of speakers 140, the Bluetooth transmitter 150 and the power supply 160 to enable an electrical connection therebetween.

In one example embodiment, as seen in FIG. 2B, the inverted triangle wiring 170 may include a first wiring member 172 and a second wiring member 174. The first wiring member 172 may diagonally extend between the first speaker 140*a* and the Bluetooth transmitter 150. Further, the second wiring member 174 may diagonally extend between the second speaker 140*b* and the Bluetooth transmitter 150. The first wiring member 172 and the second wiring member 174 may merge at a distance above the Bluetooth transmitter 150, and extends therefrom as a singular wiring member 176 up to the Bluetooth transmitter 150. The inverted triangle wiring 170 may further include a third wiring member 178 that may diagonally extend between the Bluetooth transmitter 150 and the power supply 160.

In one embodiment, the gaming chair 100 may further include a Bluetooth USB adapter 190, as seen in FIG. 2B, coupled to the inverted triangle wiring 170 and disposed along the back side 132*a* of the backrest member 130. The Bluetooth USB adapter 190 may enable the gaming chair 100 to be compatible and connect to a PC device or a PS4™ video game console device.

In one example embodiment, the gaming chair 100 may further include a receptacle 195 along the back side 132*a* of the backrest member 130 to store any item therein.

The gaming chair 100 for playing game provides new experience to game players. The gaming chair 100 provides quality audio output that directs sound close to a person's ears without use of headphones, with easiness and cleanness. The gaming chair 100 provides economic and simple wiring and circuitry designs in the chair in relation to the built-in chair installed at the backrest member of the gaming chair.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. A gaming chair comprising:

a movable stand member;

a seat member disposed over the movable stand member, the seat member having a pair of armrests extending from sides of the seat member;

a backrest member hingeably coupled to the seat member to be reclined between a first position and a second position, the backrest member having a back side, and a front side opposite to the back side, the backrest member further having:

a middle portion extending longitudinally from the seat member, the middle portion having longitudinal opposite sides, and a pair of side portions extending longitudinally from the respective longitudinal opposite sides of the middle portion in tapered manner towards the front side;

a plurality of speakers having a first speaker and a second speaker, wherein the first speaker and the second speaker are spaced apart from each other and removably disposed on back sides of the respective side portions;

a Bluetooth transmitter placed behind the backrest member along the back side of the backrest member;

a power supply placed behind the backrest member along the back side of the backrest member; and an inverted triangle wiring disposed inside the backrest member along the back side of the backrest member, wherein the inverted triangle wiring is adapted to electrically couple the plurality of speakers, the Bluetooth transmitter and the power supply to enable an electrical connection therebetween.

2. The gaming chair of claim 1, wherein the movable stand member comprises:

a longitudinal member extending from below the seat member, and a plurality of tapered members, each tapered member having a wheel, the plurality of tapered members extending taperedly from the longitudinal member.

3. The gaming chair of claim 1, wherein the movable stand member is height adjustable.

4. The gaming chair of claim 1, wherein the seat member comprises:

a middle seat portion having longitudinal opposite sides, the middle seat portion having a front seat portion substantially above in height than a back seat portion; and a pair of side seat portions extending side by side and taperedly upside from the respective longitudinal opposite sides of the middle seat portion.

5. The gaming chair of claim 1, wherein the seat member is cushioned for comfort of a user.

6. The gaming chair of claim 1, wherein the pair of armrests are height adjustable.

7. The gaming chair of claim 1, wherein the backrest member further comprises at least one cutout portion extending through the backrest member from the front side to the back side to receive a head cushion support to provide additional cushioning for enabling a user to rest a head back thereof.

8. The gaming chair of claim 1, wherein the backrest member is hingeably coupled to the seat member via a hinging attachment, wherein the hinging attachment comprises:

a first bracket element coupled to the seat member;

a second bracket element rotatably coupled and extending from the first bracket element and coupled to the backrest member via connectors; and a lever element operatively coupled to the first bracket element and the second bracket element to hingeably couple the backrest member with the seat member.

9. The gaming chair of claim 1, wherein the backrest member is cushioned for comfort of a user.

10. The gaming chair of claim 1, wherein the first speaker and the second speaker are at substantially same height and along a top portion of the back side of the backrest member to be played simultaneously.

11. The gaming chair of claim 1, wherein the Bluetooth transmitter is removably disposed behind the backrest member, the Bluetooth transmitter adapted to be connected to a mobile phone, making the thereto an external audio device for the phone.

12. The gaming chair of claim 1, wherein the power supply is removably placed behind the backrest member.

13. The gaming chair of claim 1, wherein the inverted triangle wiring comprises:

a first wiring member diagonally extending between the first speaker and the Bluetooth transmitter, and a second wiring member diagonally extending between the second speaker and the Bluetooth transmitter.

14. The gaming chair of claim 13, wherein the first wiring member and the second wiring member merge at a distance above the Bluetooth transmitter, and extends therefrom as a singular wiring member up to the Bluetooth transmitter.

15. The gaming chair of claim 13, wherein the inverted triangle wiring further comprises:

a third wiring member diagonally extending between the Bluetooth transmitter and the power supply.

16. The gaming chair of claim 1 further comprising a Bluetooth USB adapter coupled to the inverted triangle wiring and disposed along the back side of the backrest member, wherein the Bluetooth USB adapter enables the gaming chair to be compatible and connect to a PC device or a video game console device.

17. The gaming chair of claim 1 further comprising a receptacle along the back side of the backrest member.

18. The gaming chair of claim 1 further comprising a waist cushion support to provide additional cushioning along a user's waist.

19. A gaming chair comprising:

a movable stand member;

a seat member disposed over the movable stand member, the seat member having a pair of armrests extending from sides of the seat member;

a backrest member hingeably coupled to the seat member to be reclined between a first position and a second position, the backrest member having a back side, and a front side opposite to the back side, the backrest member further having:

a middle portion extending longitudinally from the seat member, the middle portion having longitudinal opposite sides, and a pair of side portions extending longitudinally from the respective longitudinal opposite sides of the middle portion in tapered manner towards the front side;

a plurality of speakers having a first speaker and a second speaker, wherein the first speaker and the second speaker are spaced apart from each other and removably disposed on back sides of the respective side portions;

a Bluetooth transmitter placed behind the backrest member along the back side of the backrest member:

a power supply placed behind the backrest member along the back side of the backrest member; and an inverted triangle wiring disposed inside the backrest member along the back side of the backrest member, wherein the inverted triangle wiring is adapted to electrically couple the plurality of speakers, the Bluetooth transmitter and the power supply to enable an electrical connection therebetween, wherein the inverted triangle wiring comprises:

a first wiring member diagonally extending between the first speaker and the Bluetooth transmitter, a second wiring member diagonally extending between the second speaker and the Bluetooth transmitter, wherein the first wiring member and the second wiring member merge at a distance above the Bluetooth transmitter, and extends therefrom as a singular wiring member up to the Bluetooth transmitter, and a third wiring member diagonally extending between the Bluetooth transmitter and the power supply.

* * * * *